US008118658B2

(12) United States Patent
Hughes

(10) Patent No.: US 8,118,658 B2
(45) Date of Patent: Feb. 21, 2012

(54) ROLLING RAFFLE GAME

(76) Inventor: Michael L. Hughes, Los Angeles, CA (US)

( * ) Notice: Subject to any disclaimer, the term of this patent is extended or adjusted under 35 U.S.C. 154(b) by 978 days.

(21) Appl. No.: 11/906,597

(22) Filed: Oct. 3, 2007

(65) Prior Publication Data

US 2009/0036192 A1 Feb. 5, 2009

Related U.S. Application Data

(63) Continuation-in-part of application No. 11/882,147, filed on Jul. 31, 2007.

(51) Int. Cl.
*A63F 9/00* (2006.01)

(52) U.S. Cl. ..... 463/17; 463/16

(58) Field of Classification Search ..... 463/16, 463/17

See application file for complete search history.

(56) References Cited

U.S. PATENT DOCUMENTS

| | | | | |
|---|---|---|---|---|
| 6,210,276 | B1 | 4/2001 | Mullins | |
| 6,793,219 | B2 * | 9/2004 | Higginson | 273/269 |
| 7,169,041 | B2 * | 1/2007 | Tessmer et al. | 463/16 |
| 7,213,811 | B2 * | 5/2007 | Bozeman | 273/139 |
| 7,351,142 | B2 * | 4/2008 | Walker et al. | 463/17 |
| 2003/0036427 | A1 * | 2/2003 | Brandstetter et al. | 463/29 |
| 2003/0060264 | A1 * | 3/2003 | Chilton et al. | 463/20 |
| 2003/0104853 | A1 * | 6/2003 | Tessmer et al. | 463/16 |
| 2003/0228901 | A1 * | 12/2003 | Walker et al. | 463/25 |
| 2004/0082377 | A1 * | 4/2004 | Seelig et al. | 463/17 |
| 2004/0209691 | A1 * | 10/2004 | Roush | 463/40 |
| 2006/0009283 | A1 * | 1/2006 | Englman et al. | 463/29 |
| 2006/0160597 | A1 * | 7/2006 | Wright | 463/16 |
| 2006/0178194 | A1 * | 8/2006 | Jubinville et al. | 463/17 |
| 2006/0205476 | A1 | 9/2006 | Jubinville | |
| 2006/0247001 | A1 * | 11/2006 | Walker et al. | 463/17 |

(Continued)

OTHER PUBLICATIONS

Search report for counterpart PCT application PCT/US2008/070392, Feb. 19, 2009.

*Primary Examiner* — Melba Bumgarner
*Assistant Examiner* — Seng H Lim
(74) *Attorney, Agent, or Firm* — Muskin & Cusick LLC

(57) ABSTRACT

A game of chance add-on raffle game, independent base game and a system for funding the raffle game prize payout is provided. For a premium wager, an add-on raffle game is offered to be added to a state on-line lottery game play at the time of the initial base game play purchase in one embodiment of the present invention. The add-on game play status is printed on the base game ticket. All players of the base game (who purchased the add-on game or not) who achieve a predetermined outcome receive a raffle ticket containing a unique ticket number that will automatically be entered into the following add-on game raffle drawing at no additional cost. The raffle drawing is held, and the winning raffle numbers are identified. Winning raffle ticket recipients submit their tickets to the lottery authority for their prize. A determination is made if the add-on game was purchased with the base game play associated to the winning raffle ticket. If the add-on game was purchased with the base game play associated to the winning raffle ticket, the player receives the raffle prize. If the add-on game was not purchased with the base game play associated to the winning raffle ticket the player receives a free QP lottery ticket in lieu of receiving the raffle prize and the unpaid raffle prize or a percentage of the unpaid raffle prize will rollover to a subsequent raffle drawing.

7 Claims, 10 Drawing Sheets

U.S. PATENT DOCUMENTS

2006/0252489 A1* 11/2006 Walker et al. ..... 463/17
2006/0261545 A1 11/2006 Rogers
2007/0026927 A1 2/2007 Yaldoo
2007/0123341 A1* 5/2007 Tessmer et al. ..... 463/16
2007/0249418 A1* 10/2007 Jubinville et al. ..... 463/17
2008/0070703 A1* 3/2008 Campo et al. ..... 463/46
2009/0117966 A1* 5/2009 Rogers et al. ..... 463/17
2009/0131140 A1* 5/2009 Szrek et al. ..... 463/17
2009/0186680 A1* 7/2009 Napolitano et al. ..... 463/17
2010/0041464 A1* 2/2010 Arezina et al. ..... 463/22

* cited by examiner

FIG. 2.

US State Lotteries Offering Raffles

| | | | | | Prizes Offered | | | | | | | | | | | | | |
|---|---|---|---|---|---|---|---|---|---|---|---|---|---|---|---|---|---|---|
| State | Raffle Game | Ticket Price | # Tickets Offered | Game Frequency | $20,000,000 | $2,000,000 | $1,000,000 | $500,000 | $250,000 | $100,000 | $50,000 | $25,000 | $10,000 | $5,000 | $1,000 | $500 | $250 | $100 |
| DC | Millionaire Raffle | $10 | 250,000 | 1x year | -- | -- | 1 | -- | -- | -- | 3 | -- | -- | -- | 100 | -- | -- | -- |
| DE | Delaware Raffle | $10 | 100,000 | 1x year | -- | -- | -- | -- | 1 | -- | -- | 5 | -- | -- | -- | 250 | -- | -- |
| FL | Firecracker Millionaire Raffle | $20 | 1,500,000 | 1x year | -- | -- | 12 | -- | -- | 25 | -- | -- | 200 | -- | -- | -- | -- | -- |
| FL | Holiday Millionaire Raffle | $20 | 1,250,000 | 1x year | -- | -- | 10 | -- | -- | 20 | -- | -- | 100 | -- | -- | -- | -- | -- |
| GA | Millionaire Raffle | $20 | 500,000 | 2x year | -- | -- | 4 | -- | -- | 5 | -- | -- | -- | -- | 500 | -- | -- | -- |
| IL | Millionaire Raffle | $20 | 500,000 | 1x year | -- | -- | 4 | -- | -- | 5 | -- | -- | -- | -- | 500 | -- | -- | -- |
| IN | Millionaire Raffle | $20 | 325,000 | 1x year | -- | -- | 2 | -- | -- | 5 | -- | -- | -- | -- | 770 | -- | -- | -- |
| KY | Million Dollar Draw | $10 | 500,000 | 1x year | -- | -- | 2 | -- | -- | -- | 2 | -- | 30 | -- | -- | 700 | -- | -- |
| KY | Lucky 7's Raffle | $5 | 500,000 | 1x year | -- | -- | -- | 2 | -- | -- | -- | 2 | -- | 30 | -- | -- | 700 | -- |
| MA | Star Spangled Sweepstakes | $20 | 4,000,000 | 1x year | 1 | -- | 10 | -- | 40 | -- | -- | -- | -- | -- | -- | -- | -- | -- |
| MD | Countdown to Millions Raffle | $20 | 420,000 | 2x year | -- | -- | 4 | -- | -- | -- | 8 | -- | -- | -- | 200 | 600 | -- | -- |
| MI | Millionaire Raffle | $20 | 600,000 | 3x year | -- | -- | 6 | -- | -- | 12 | -- | -- | -- | -- | -- | 2,000 | -- | -- |
| MI | Super Raffle | $50 | 250,000 | 1x year | -- | 2 | -- | -- | -- | 25 | -- | -- | -- | -- | -- | 4500 | -- | -- |
| MN | Millionaire Raffle | $10 | 500,000 | 1x year | -- | -- | 2 | -- | -- | 4 | -- | 4 | -- | -- | -- | 100 | -- | -- |
| MT | Montana Millionaire | $20 | 150,000 | 1x year | -- | -- | 1 | -- | -- | 5 | -- | -- | 5 | 4 | -- | -- | -- | -- |
| NC | Sizzlin Millionaire Raffle | $20 | 500,000 | 1x year | -- | -- | 4 | -- | -- | 5 | -- | 10 | -- | -- | 500 | -- | -- | -- |
| NJ | Independence Day Raffle; | $20 | 500,000 | 1x year | -- | -- | 4 | -- | -- | 5 | -- | -- | -- | -- | -- | 500 | -- | -- |
| NJ | Mill. Dollar New Year Raffle | $20 | 500,000 | 1x year | -- | -- | 4 | -- | -- | 5 | -- | 10 | -- | -- | -- | 500 | -- | -- |
| NY | Raffles to Riches | $20 | 1,500,000 | 2x year | -- | -- | 14 | -- | -- | 14 | -- | 30 | 40 | -- | -- | -- | -- | -- |
| OK | 1st Anniversary Raffle | $5 | 200,000 | 1x year | -- | -- | | -- | 1 | -- | 2 | -- | -- | -- | -- | 300 | -- | -- |
| PA | Millionaire Raffle | $20 | 625,000 | 2x year | -- | -- | 5 | -- | -- | 5 | -- | -- | -- | -- | 200 | -- | -- | 7,567 |
| SC | Millionaire Raffle | $10 | 1,000,000 | 1x year | -- | -- | 4 | -- | -- | 2 | -- | -- | 60 | -- | 700 | -- | -- | -- |
| TN | Million $ Madness Raffle | $10 | 800,000 | 1x year | -- | -- | 4 | -- | -- | -- | 50 | -- | -- | -- | -- | 100 | -- | -- |
| VA | Millionaire Raffle | $20 | 330,000 | 1x year | -- | -- | 3 | -- | -- | -- | 3 | -- | -- | -- | -- | 300 | -- | -- |

200

2006 FL Lotto Jackpot / Ticket Sales Comparison

| Jackpot | Avg. Ticket Sales | |
|---|---|---|
| $1,000,000 - $4,999,999 | $5,573,986 | |
| $5,000,000 - $9,999,999 | $6,899,332 | 24% increase |
| $10,000,000 - $14,999,999 | $9,582,741 | 72% increase |
| $15,000,000 - $19,999,999 | $11,133,415 | 100% increase |
| $20,000,000 - $29,999,999 | $15,112,770 | 171% increase |
| $30,000,000 - $39,999,999 | $21,693,107 | 289% increase |
| $40,000,000 - $49,999,999 | $34,011,797 | 510% increase |

FIG. 6.

LIGHTNING STRIKES TWICE™ PRIZE POOL

LST Prize Pool = 50 percent of the Lightning Strikes Twice™ add-on game revenues:

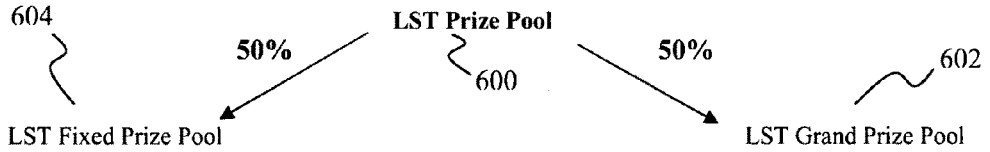

Fixed Prize Pool: 50 percent (50%) of the prize pool for the drawing plus any fixed prize money carried forward from the previous draws.

The Fixed Prize Pool is allocated to a number of subcategory set $1 million, $100,000, $10,000, and $500 prize units:

| **Set Prize Pool Example:** | **$2,119,347** | | |
|---|---|---|---|
| 75% of prize pool, rounded down | $1,000,000 | (1) | $1 million prize |
| 75% of remaining prize pool, rounded down | $ 800,000 | (8) | $100,000 prizes |
| 75% of remaining prize pool, rounded down | $ 230,000 | (23) | $10,000 prizes |
| 100% of remaining prize pool, rounded down | $ 89,000 | (178) | $500 prizes |
| 100% of remaining prize pool | $ 347 | (347) | QP Ticket Reserve |

606 608 610 612 614

* All fixed prizes awarded are paid as single lump sum prizes.

Fixed Prize pool allocation can be modified from time to time to include a number of different prize payouts which keeps the game fresh and dynamic, i.e. (1) $1 MILLION prize or (2,000) $500 prizes.

Grand Prize Pool: 50 percent (50%) of the Prize Pool for the drawing plus any grand prize money carried forward from the previous draws.

Grand Prize Pool Example: $2,119,347 x LST Annuity Factor = $4,500,000 GRAND PRIZE

Grand Prize amount is estimated using a 30-payment (30 payments over 29 years) deferred payment factor.

FIG. 7.

Model based on 2006 ticket sales & winners matching at least 3 numbers of the FLORIDA LOTTERY jackpot games Lotto™, Mega Money®, and Fantasy 5™

701 700 702 - 708 712 710 714 - 718 719 720 722 - 728 732 - 736 730

| | TICKET SALES | | | | | FIXED PRIZES | | | | | | GRAND PRIZE | | | | ODDS | | |
|---|---|---|---|---|---|---|---|---|---|---|---|---|---|---|---|---|---|---|
| | Base Game Total Sales | LST Sell Through | LST Rider Ticket Sales | LST Weekly Prize Pool | Total Fixed Prize Pool | LST Fixed Prizes 1M | 100k | 10k | $500 | QP Tkt Reserve | % Prize Payout | Total Grand Prize Pool | Annuitized Grand Prize | Prize Winners | Payout Probability | Base Game Qualifiers | Prizes Offered | Odds of Winning |
| Week 1: Jan 1-7 | $24,811,199 | 10.00% | $2,481,120 | $1,240,560 | $620,280 | 0 | 4 | 16 | 120 | 260 | 10.00% | $620,280 | $1,319,745 | rollover | 10.00% | 374,907 | 141 | 1:2,659 |
| Week 2: Jan 8-14 | $30,543,246 | 10.00% | $3,054,325 | $1,527,162 | $1,321,581 | 0 | 9 | 31 | 223 | 81 | 10.00% | $1,383,861 | $2,944,385 | rollover | 10.00% | 429,246 | 264 | 1:1,626 |
| Week 3: Jan 15-21 | $41,274,325 | 10.00% | $4,127,433 | $2,063,716 | $2,221,208 | 1 | 9 | 24 | 162 | 208 | 10.00% | $2,415,719 | $5,139,827 | rollover | 10.00% | 547,260 | 197 | 1:2,778 |
| Week 4: Jan 22-28 | $19,946,687 | 12.40% | $2,473,389 | $1,236,694 | $2,617,247 | 1 | 12 | 31 | 214 | 247 | 12.40% | $3,034,066 | $6,455,460 | rollover | 12.40% | 259,037 | 259 | 1:1,000 |
| Week 5: Jan 29-Feb 4 | $20,060,376 | 12.40% | $2,487,486 | $1,243,743 | $2,914,363 | 2 | 6 | 23 | 168 | 363 | 12.40% | $3,655,937 | $7,778,590 | rollover | 12.40% | 242,815 | 200 | 1:1,214 |
| Week 6: Feb 5-11 | $23,653,794 | 12.40% | $2,933,070 | $1,466,535 | $3,285,931 | 2 | 9 | 28 | 211 | 431 | 12.40% | $4,389,204 | $9,338,733 | rollover | 12.40% | 327,271 | 251 | 1:1,304 |
| Week 7: Feb 12-18 | $19,978,245 | 17.20% | $3,436,258 | $1,718,129 | $4,144,564 | 3 | 8 | 25 | 189 | 64 | 17.20% | $5,248,268 | $11,166,528 | rollover | 17.20% | 263,171 | 226 | 1:1,164 |
| Week 8: Feb 19-25 | $21,594,683 | 17.20% | $3,714,285 | $1,857,142 | $4,360,217 | 3 | 9 | 34 | 240 | 217 | 17.20% | $6,176,839 | $13,142,211 | rollover | 17.20% | 257,935 | 287 | 1:899 |
| Week 9: Feb 26-Mar 4 | $23,052,965 | 17.20% | $3,965,110 | $1,982,555 | $4,601,357 | 3 | 12 | 30 | 202 | 357 | 17.20% | $7,168,116 | $15,251,311 | rollover | 17.20% | 374,926 | 248 | 1:1,512 |
| Week 10: Mar 5-11 | $19,972,433 | 20.00% | $3,994,486 | $1,997,243 | $4,808,249 | 3 | 13 | 38 | 256 | 249 | 20.00% | $8,166,737 | $17,376,037 | rollover | 20.00% | 293,007 | 311 | 1:942 |
| Week 11: Mar 12-18 | $19,554,547 | 20.00% | $3,910,909 | $1,955,454 | $4,824,127 | 3 | 13 | 39 | 268 | 127 | 20.00% | $9,144,464 | $19,456,306 | rollover | 20.00% | 232,749 | 324 | 1:718 |
| Week 12: Mar 19-25 | $24,154,478 | 25.00% | $6,038,620 | $3,019,310 | $5,368,855 | 4 | 9 | 35 | 237 | 355 | 25.00% | $10,654,119 | $22,668,338 | 1 | 25.00% | 303,860 | 286 | 1:1,062 |
| Week 13: Mar 26-Apr 1 | $28,140,963 | 10.00% | $2,814,096 | $1,407,048 | $4,729,899 | 3 | 12 | 39 | 279 | 399 | 10.00% | $703,524 | $1,496,860 | rollover | 10.00% | 392,720 | 334 | 1:1,176 |
| Week 14: Apr 2 - 8 | $35,308,355 | 10.00% | $3,530,835 | $1,765,417 | $5,139,258 | 3 | 16 | 40 | 278 | 258 | 10.00% | $1,586,232 | $3,374,961 | rollover | 10.00% | 453,329 | 338 | 1:1,341 |
| Week 15: Apr 9 - 15 | $50,365,900 | 12.40% | $6,245,372 | $3,122,686 | $6,186,443 | 4 | 16 | 43 | 312 | 443 | 12.40% | $3,147,575 | $6,696,968 | rollover | 12.40% | 733,773 | 376 | 1:1,952 |
| Week 16: Apr 16- 22 | $49,322,652 | 17.20% | $8,483,496 | $4,241,748 | $7,539,810 | 5 | 19 | 47 | 339 | 310 | 17.20% | $5,268,449 | $11,209,465 | rollover | 17.20% | 721,038 | 411 | 1:1,754 |
| Week 17: Apr 23 - 29 | $23,101,981 | 17.20% | $3,973,541 | $1,986,770 | $7,236,091 | 5 | 16 | 47 | 332 | 91 | 17.20% | $6,261,834 | $13,323,051 | rollover | 17.20% | 317,897 | 401 | 1:793 |
| Week 18: Apr 30 - May 6 | $19,781,321 | 17.20% | $3,402,387 | $1,701,193 | $6,842,004 | 5 | 13 | 40 | 284 | 4 | 17.20% | $7,112,431 | $15,132,831 | rollover | 17.20% | 301,366 | 343 | 1:877 |
| Week 19: May 7 - 13 | $21,231,346 | 20.00% | $4,246,269 | $2,123,134 | $6,726,743 | 5 | 12 | 39 | 273 | 243 | 20.00% | $8,173,998 | $17,391,485 | 1 | 20.00% | 286,123 | 330 | 1:867 |
| Week 20: May 14 - 20 | $19,137,834 | 10.00% | $1,913,783 | $956,891 | $5,859,645 | 4 | 13 | 41 | 299 | 145 | 10.00% | $478,445 | $1,017,970 | rollover | 10.00% | 272,869 | 358 | 1:762 |
| Week 21: May 21 - 27 | $18,282,704 | 10.00% | $1,828,270 | $914,135 | $5,730,617 | 4 | 12 | 39 | 281 | 117 | 10.00% | $935,513 | $1,990,453 | rollover | 10.00% | 264,629 | 337 | 1:785 |
| Week 22: May 28 - Jun 3 | $20,228,910 | 10.00% | $2,022,891 | $1,011,445 | $5,663,172 | 4 | 12 | 34 | 246 | 172 | 10.00% | $1,441,235 | $3,066,459 | rollover | 10.00% | 265,048 | 297 | 1:892 |
| Week 23: Jun 4 - 10 | $18,913,915 | 12.40% | $2,345,325 | $1,172,662 | $5,683,031 | 4 | 12 | 36 | 246 | 31 | 12.40% | $2,027,566 | $4,313,970 | rollover | 12.40% | 240,827 | 299 | 1:805 |
| Week 24: Jun 11 - 17 | $21,249,633 | 12.40% | $2,634,954 | $1,317,477 | $5,637,046 | 4 | 12 | 32 | 234 | 46 | 12.40% | $2,686,305 | $5,715,542 | rollover | 12.40% | 296,642 | 283 | 1:1,048 |
| Week 25: Jun 18 - 24 | $21,039,652 | 12.40% | $2,608,917 | $1,304,458 | $5,590,241 | 4 | 11 | 36 | 260 | 241 | 12.40% | $3,338,534 | $7,103,264 | rollover | 12.40% | 250,125 | 312 | 1:802 |
| Week 26: Jun 25 - Jul 1 | $18,823,884 | 17.20% | $3,237,708 | $1,618,854 | $5,706,267 | 4 | 12 | 37 | 272 | 267 | 17.20% | $4,147,961 | $8,825,449 | 1 | 17.20% | 241,513 | 326 | 1:740 |
| TOTALS | $653,526,028 | 14.32% | $91,904,335 | $45,952,167 | $125,358,246 | 83 | 301 | 904 | 6,425 | 5,746 | 14.32% | $109,367,212 | $232,696,199 | 3 | 14.32% | 344,003 | 7,739 | 1:1,678 |

740

ROLLING RAFFLE GAME

This application is a continuation in part of application Ser. No. 11/882,147 which was filed with the United States Patent and Trademark Office on Jul. 31, 2007 and is incorporated herein by reference.

BACKGROUND OF THE INVENTION

The present invention relates generally to games of chance, such as state or nationally sponsored lotto/lottery games, but can be applied to other games of chance as well, such as bingo or casino games, or any other type of venue which contains an unpredictable outcome that a player participates in. More specifically, the invention is a progressive raffle add-on game that is added to a base game of chance where the outcome is partially determined by the wager a player placed upon playing the base game play. For conceptual purposes, the present invention will be described as applied to state lottery games hereunder, but shall not be viewed as fixed or limited to such application.

While each national/state lottery has its own rules which vary slightly and are usually published on their websites, and while some states/nations now permit the purchase of lottery tickets through the internet, the following is just one example of basic lotto rules or regulations, how to play the game, and game summary which are presented for foundational purposes and should additionally not be viewed as fixed or limiting.

Lotto Game Summary:

A player chooses six numbers from 1 to 49. Six numbers are drawn plus a bonus number, out of 49 numbered balls. If a player matches all 6 numbers, they win the jackpot. If they match 5 numbers and the bonus number, they win the second highest prize. If they match five, four or three numbers, they can win smaller prizes.

How to Play Lotto:

First, mark six numbers on any individual lottery board or lottery play slip. On some lottery play slips a player can play with more than one set of numbers. A player can also buy tickets without completing a play slip. The player allows the computer terminal choose six-number combinations at random.

Some play slips allow a player to play the same numbers for more than one week (for several draws). The player needs to mark the appropriate section accordingly. The player will only receive one ticket, but their numbers will be entered for the draw-days and number of weeks selected.

A player takes the completed lottery play slip to a retailer or lottery terminal. They will enter the player's selections into the terminal and give the player a Lotto/Lottery game ticket. The player is responsible for checking that the information it contains is correct—the numbers, the days they wish to play, the number of weeks and the draw date(s).

Where applicable, they must also check that the bar-coded serial number on the ticket is clearly readable and that the "Void" box has not been marked. The player is encouraged to keep their ticket safe as they'll need it to claim their prize, as it is the only proof that they are a winner. It is recommended that they put their name and address on the reverse of the ticket for security purposes.

If any of the six-number Lottery/Lotto game selections on their ticket matches the main six numbers drawn in the relevant Lottery/Lotto game draw—in any order—they are a jackpot winner. In some cases, they may have to share the jackpot with other winners. They can also win smaller amounts by matching five, four or even three main numbers out of six. In some states/nations, if they have matched five numbers already, matching the bonus number will win them the second highest prize.

Basic Lotto/Lottery Game Rules and Regulations for Popular Lotteries:

- A player must be 16/18/21 years of age or older to buy Lotto/Lottery tickets and claim prizes.
- Players are responsible for checking their tickets before leaving the retailer location.
- A ticket is void if stolen, unissued, mutilated, illegible, tampered with or altered in any way, defective or incomplete.
- The Lottery is not responsible for lost or stolen tickets.
- A Lotto/Lottery ticket may be cancelled only if presented before the drawing to the Retailer where it was originally purchased.
- A player must fill in their name, address and phone number on the back of their winning ticket before they file a prize claim.
- All winning tickets are subject to validation by the Lottery.
- All winning tickets are bearer instruments.
- All prizes must be claimed within 6 months/one year from date of drawing.

Lottery games have always been popular, and have provided consistently growing revenues for education in many states/nations.

Industry research shows lottery games with higher overall payouts and payout chances create more "winning experiences" for players, and sell better. Almost 10 years ago, many states began to introduce premium variations of traditional scratch-off, instant win lottery tickets. For a higher price such as $2.00-$10.00 instead of the traditional $1.00, players could experience multiple winning opportunities or better odds with higher payouts, which enhanced their overall chances and playing experience. As a result, scratch-off, instant win lottery ticket revenues have surpassed traditional lotto revenues in many states, and continue to thrive while traditional lotto revenues remain stagnant, and in some states are consistently declining.

Of particular interest is the observation of Lotto/Lottery game analysts that consumers are most receptive to purchasing a new game in the first 4 weeks it is offered for sale. This puts the burden on game designers to constantly create new, innovative gaming ideas or a means for consistently repackaging existing games to appear fresh.

Efforts to raise traditional lotto sales, such as increasing drawings from 1× week to 2× a week, have been implemented, but due to the already high payout expectation in the minds of consumers, lottery authorities have been challenged to provide a fresh lotto innovation that would demand a ticket price higher than the traditional $1.00 per ticket.

In recent years, several state lotteries have incorporated a raffle on an annual or semi-annual basis as seen in FIG. 2. One of the most popular state raffles is named the Millionaire Raffle and offers players the best odds to win $1 million dollars, where sponsoring states offer a limited number of raffle tickets at an average price of $20 per ticket. Each ticket contains one unique number which is included in a raffle drawing. The total amount of the prizes offered is typically close to 50% of the total revenues generated by the particular raffle drawing, and are typically divided amongst several fixed $1 million, $100,000, $10,000 and $500 prizes. The amount of fixed prizes and prize amounts are predetermined by each state lottery before tickets are sold.

Raffle games such as the Millionaire Raffle have been widely and enthusiastically accepted by players across all states, with many raffle tickets selling out only days or weeks after tickets are offered for sale, and only a handful of smaller state lotteries have completed their sales period with unsold tickets remaining.

As successful as state raffle drawings have been however, the very nature & structure of a raffle drawing offers several limitations to the sponsoring state's efforts in increasing revenues. The most apparent limitations are as follows: (1) An average ticket price between $10-$20 is much higher than the cost of a traditional lottery ticket, and may be more than the typical lottery player is willing to pay on an on-going basis. (2) The number of fixed prizes offered is typically based on the assumption that all tickets will be sold; offering a number of fixed prizes which are not determined on a pari-mutuel basis transfers the risk to the sponsoring lottery if all the tickets are not sold. (3) A raffle drawing can be a cannibal game, absorbing funds that would otherwise be spent on other state lottery games. (4) Promoting the typical raffle game is time consuming, often requiring a 6-8 week sales period for a single raffle drawing, and (5) the very nature of a raffle dictates that all prizes are paid out in a single drawing which prevents the typical raffle game from utilizing the most influential factor in increasing game sales known to date; the rolling jackpot. As seen in FIG. 3, a case study of the 2006 ticket sales of the Florida Lotto™ game shows that the average number of ticket sales increase by over 500 percent (500%) when a larger jackpot is available.

Of background interest is application WO 2007/092530 by SCIENTIFIC GAMES ROYALTY CORP ET AL titled LOTTERY GAME HAVING AN INDEPENDENT RAFFLE PRIZE. SCIENTIFIC teaches of a lottery game with a capped jackpot prize and increasing raffle prize where if there is no jackpot winner for the lottery game drawing, the jackpot is increased until the jackpot is at least equal to a predefined value. If there is no jackpot winner for the lottery game drawing and the jackpot prize is at least equal to a predefined value, a raffle prize is established. If there is no jackpot winner for the lottery game drawing and a raffle prize is established, the raffle prize is incremented.

While a novel means of incorporating a raffle to an on-line lottery game, there are disadvantages which may limit the commercialization of such a game. (1) While the game is in the spirit of a raffle, it offers a limited number of prizes, as each prize is $1 million dollars (2) Capping the jackpot prize of the base game may cause players to lose interest rather than promote interest (3) the drawings depict a $2.00 price per play indicating a premium cost over the traditional $1.00 to play such a game. A concern is until the jackpot exceeds the minimum threshold to trigger the raffle game, if players would be willing to pay the additional cost vs. 2 plays of a traditional on-line lottery game. (4) The game can be a cannibal game, absorbing funds that would otherwise be spent on other state lottery games. (5) The aspect of the raffle prizes is not being distributed to the raffle winners until a jackpot winner is determined might be a turn-off for faithful players who have paid the premium wager, received their raffle numbers, realized they were in possession of a winning $1 million raffle ticket, then not receiving the jackpot through no fault of their own. Therefore, an improved raffle game which addresses the aforementioned shortcomings of the prior art is still needed.

BRIEF DESCRIPTION OF THE DRAWINGS

This invention may be embodied in the form illustrated in the accompanying drawings, attention being called to the fact, however, that the drawings are illustrative only, and that changes may be made in the specific construction illustrated.

Various other objects, features and attendant advantages of the present invention will become fully appreciated as the same becomes better understood when considered in conjunction with the accompanying drawings.

FIG. 2 is a table depicting the data of raffles currently offered by state lotteries throughout the United States;

FIG. 6 is a chart depicting the allocation of the prize pool in one embodiment of the present invention;

FIG. 7 is a table depicting a model of the add-on game of the present invention if applied to the Florida on-line lottery jackpot games based on 2006 data published by the Florida lottery;

DETAILED DESCRIPTION OF THE INVENTION

Turning now descriptively to the drawings, the attached figures illustrate various embodiments of a game of chance add-on raffle game, an independent raffle game, and a system for funding the raffle game prize payout. In one embodiment, the present invention is an add-on raffle game to be added to a casino game of chance, a bingo game, sporting venue, or any venue with an unpredictable outcome that a player can participate in with a wager.

In this respect, before explaining at least one embodiment of the invention in detail, it is to be understood that the invention is not limited in its application to the details of the arrangements of the components set forth in the following description, steps or illustrations. Additionally, it is to be understood that the phraseology and terminology employed herein, including game instructions, game cost, amount of numbers selected to play, amount of matching indicia required for a winning or qualifying outcome are for the purpose of the description and should not be regarded as limiting. The add-on game as depicted in one embodiment of the present invention is referred to herein as Lightning Strikes Twice™ ("LST"); a name trademarked for use with the present embodiment. A single add-on game play, base game play, jackpot game play, raffle game play and on-line game play are referred to herein as add-on game, base game, jackpot game, raffle game and on-line game.

Figure 1:
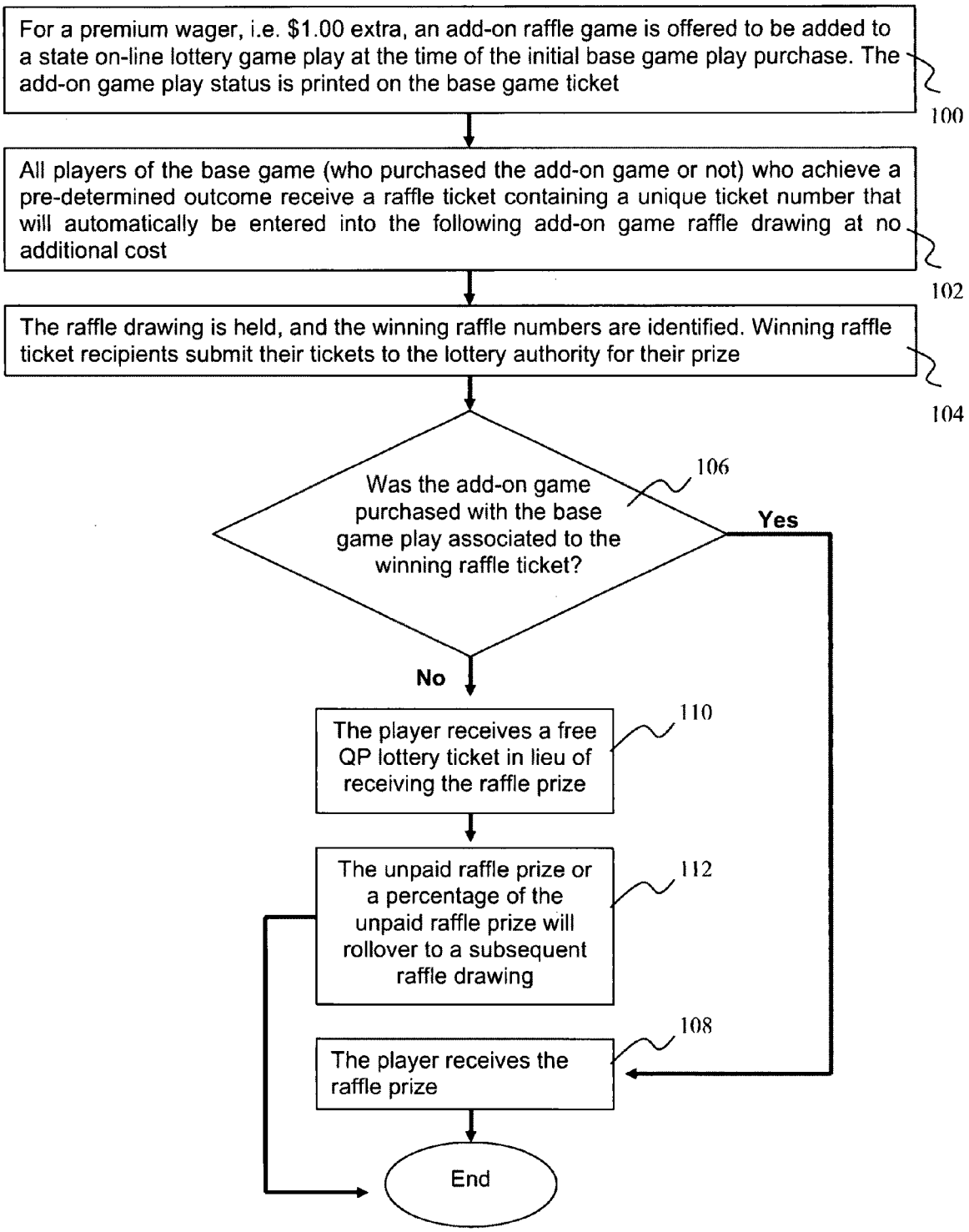
FIG. 1 depicts the premise of the add-on raffle game, according to one embodiment of the present invention.

FIG. 1. depicts the premise of the add-on raffle game, according to one embodiment of the present invention. For a premium wager, i.e. $1.00 extra, an add-on raffle game play is offered to be added to a state on-line lottery game play at the time of the initial base game play purchase 100. The add-on game play status is printed on the base game ticket. In one embodiment, the add-on game play is played in a single state, jurisdiction or country, or simultaneously in a plurality of states, jurisdictions or countries and is added to either jackpot games only, instant games (scratch-off tickets) or all on-line games. If played simultaneously in a plurality of states, jurisdictions or countries, a percentage of revenues received from ticket sales would be allocated to the states the ticket sales originated in, and a percentage of revenues received from ticket sales would be allocated to at least one prize pool across all participating states, jurisdictions, or countries.

All players of the base game (who purchased the add-on game or not) who achieve a pre-determined outcome, i.e. matching at least 3 winning numbers in a base game drawing will, upon their ticket redemption, receive a raffle ticket containing a unique ticket number that will automatically be entered into the following add-on game raffle drawing at no additional cost 102. In one embodiment, the raffle ticket contains an indication of whether or not the add-on raffle game was purchased with the associated base game play. In one embodiment, the qualifying outcome to receive a raffle ticket is determined by the lottery authority, i.e. the qualifying outcome that normally results in awarding a free QP lottery ticket could be the qualifying event to award the add-on game raffle ticket instead. In one embodiment, the unique raffle number is issued at the time of the initial base game purchase and is printed on all base game tickets.

The add-on game raffle drawing is held periodically, i.e. weekly, and is where winning raffle numbers are identified. In one embodiment, each raffle drawing offers a number of fixed cash prizes and a pari-mutuel grand prize. In one embodiment, fifty percent of the prize pool is allocated to a number of fixed prizes, the other fifty percent of the prize pool is allocated to a grand prize. In one embodiment, the complete prize pool is allocated to either a number of fixed prizes or a pari-mutuel grand prize.

The raffle drawing is held, and the winning raffle numbers are identified. Winning raffle ticket recipients submit their tickets to the lottery authority for their prize 104. A determination is made whether the add-on raffle game was purchased along with the base game play associated to the winning raffle ticket 106 If the add-on raffle game was purchased with base game play associated to the winning raffle ticket, the player receives the raffle prize 108. If the add-on raffle game was not purchased with base game play associated to the winning raffle ticket, the player receives a free QP lottery ticket in lieu of receiving the raffle prize 110. In one embodiment, the player receives no prize, a raffle ticket for a subsequent drawing or an amount lesser than if they had purchased the add-on raffle game while purchasing the base game.

The unpaid raffle prize or a percentage of the unpaid raffle prize will rollover to a subsequent raffle drawing 112. In one embodiment, a rolldown prize structure is offered where in the event that a raffle prize is not awarded, a percentage of the prize money is allocated to smaller prizes in the same drawing rather than being carried forward to enhance prizes of a subsequent drawing. In one embodiment, there are "non-winning" raffle numbers or "non-winning units" entered into a raffle drawing for the purpose of offering unpredictability in a raffle prize payout. If a non-winning raffle number or non-winning unit is drawn, the prize associated to that particular draw is not awarded. In one embodiment, the unpaid prize rolls over to a subsequent game. In one embodiment, the number of raffle numbers or "non-winning units" entered into a drawing is associated to an unpredictable event, i.e., the number of winners who successfully achieve a pre-determined outcome, i.e. match 3 numbers, or the total number of plays in a base game.

In one embodiment of the present invention, a unique raffle number is randomly issued on only some of the base game tickets, and prints along with the initial base game play or is printed on the base game tickets. All raffle numbers are entered into a subsequent drawing, and all prizes are awarded to all recipients of winning raffle numbers.

FIG. 2 is a table depicting the data of raffles currently offered by state lotteries throughout the United States. Non-existent only years earlier, state raffle games are currently offered in 20 different states 200, proving to be one of the fastest growing games in present times.

Figures 3, 4:
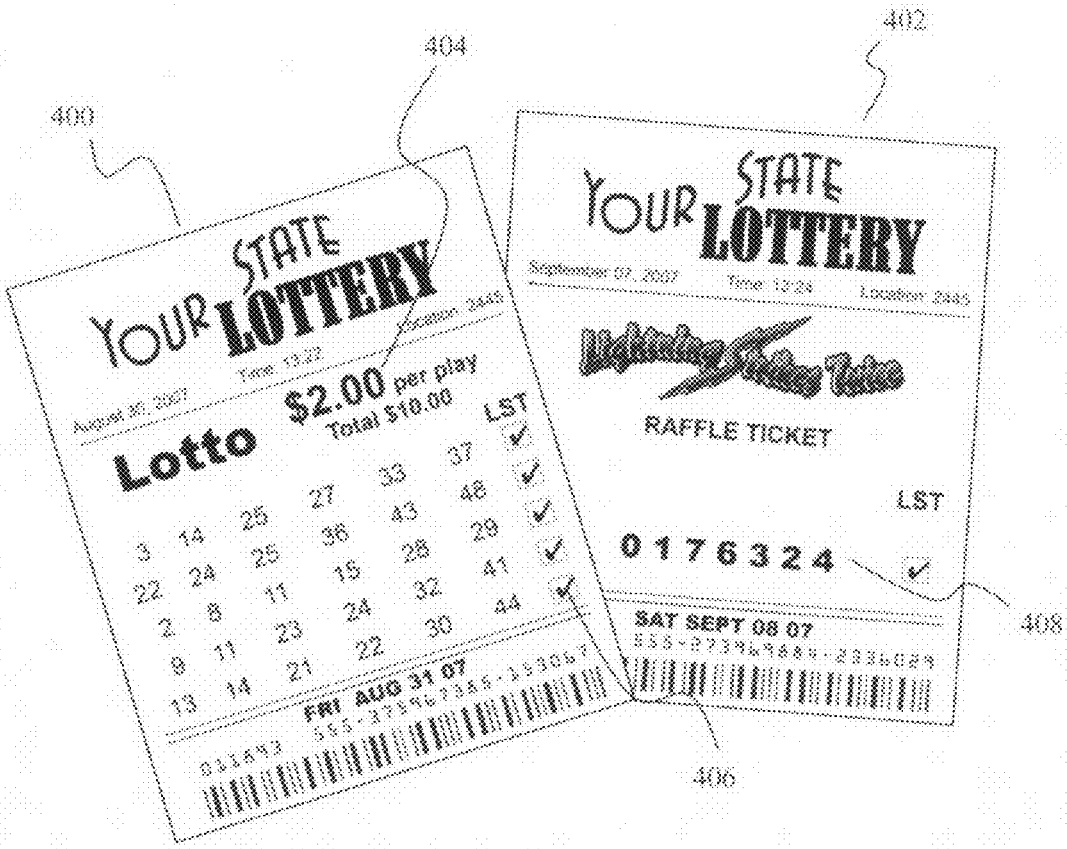
FIG. 3 is a table depicting the relationship between the average jackpot size and the corresponding amount of ticket sales based on 2006 data published by the Florida Lotto game.
FIG. 4 depicts a plan front view of a lotto ticket and raffle ticket incorporating the raffle game of the present invention.

FIG. 3 is a table depicting the relationship between the average jackpot size and the corresponding amount of ticket sales based on 2006 data published by the Florida Lotto game. As depicted, an incrementing jackpot breeds excitement and player interest, with play activity up over 500% 300 when larger jackpots are offered.

FIG. 4 depicts a plan front view of a lotto ticket 400 and raffle ticket 402 of the add-on game of the present invention. The lotto ticket 400 depicts a premium price per play of $2.00 404 and a Lightning Strikes Twice ("LST") checkbox 406, indicating whether or not the player purchased the add-on raffle game of the present invention while purchasing the base game. The raffle ticket 402 depicts a unique raffle number 408 that will automatically be entered into the following Lightning Strikes Twice™ raffle drawing. The raffle ticket 402 does not have a depicted price, as it is obtained at no additional cost by all base game players who successfully match 3 official winning numbers in a base game, as defined in one embodiment of the present invention, or another qualifying outcome as determined by the lottery. The raffle ticket 402 does depict a Lightning Strikes Twice ("LST") checkbox 406, indicating whether or not the player purchased the add-on game of the present invention while purchasing the base game. In one embodiment, a player is required to purchase the raffle ticket.

Figure 5A:
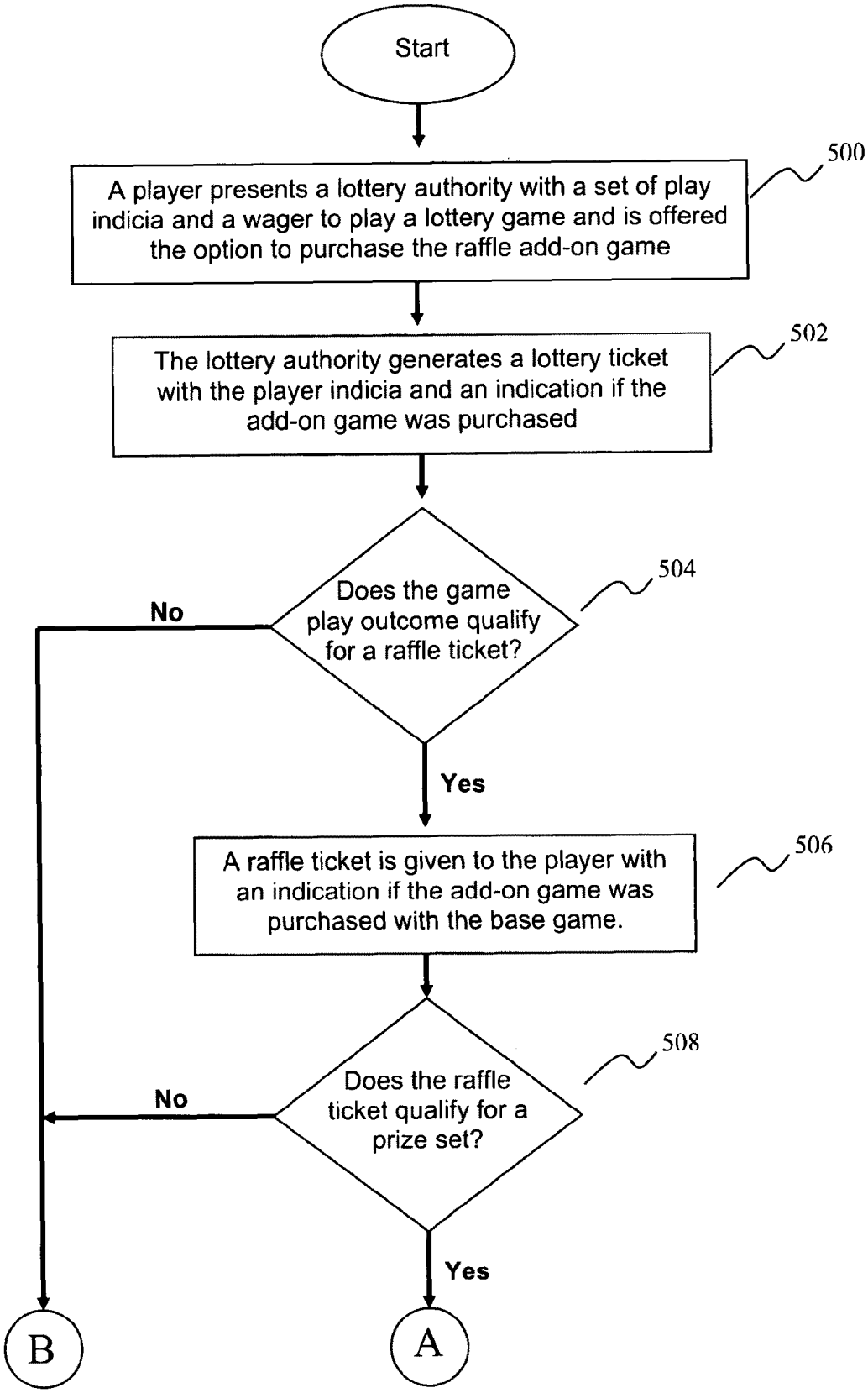
FIGS. 5A&B depict a game player process according to one embodiment of the present invention.
Figure 5B:
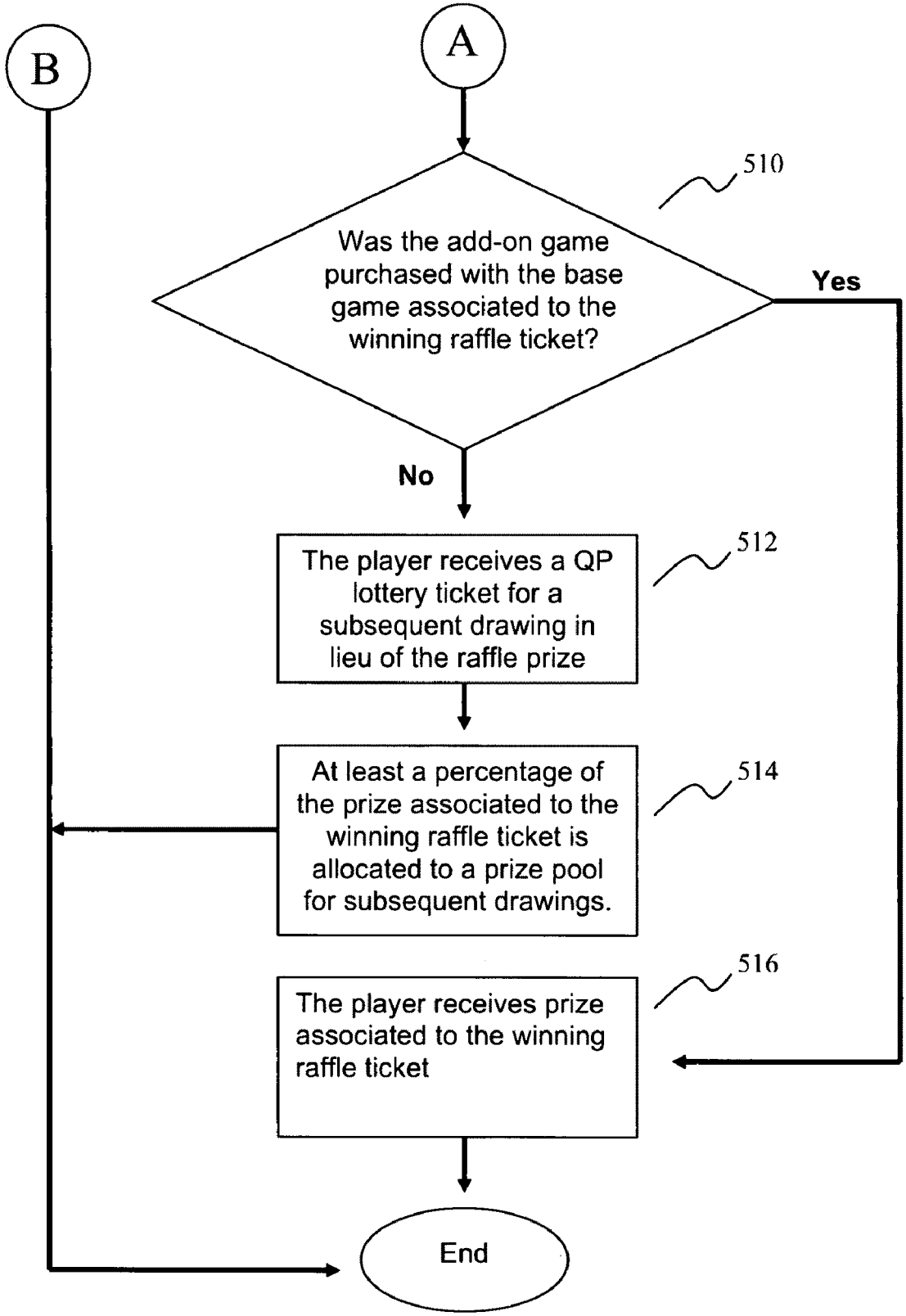

FIG. 5 illustrates a player process according to one embodiment of the present invention. A player presents a lottery authority with a set of player indicia and a wager to play a lottery game and is offered the option to purchase the raffle add-on game play 500. The lottery authority generates a lottery ticket with a set of player indicia and an indication if the add-on game play was purchased 502.

If the player achieves a qualifying outcome, i.e. matches at least 3 winning numbers in the base game, they submit the lottery ticket to the lottery authority, who determines 504 if the game play outcome qualifies for a raffle ticket.

If the game play outcome does qualify for a raffle ticket, the lottery authority generates 506 a raffle ticket with raffle indicia and with an indication if the add-on game was purchased with the base game and gives it to the player. After the raffle drawing, the player submits the raffle ticket to the lottery authority, who determines 508 if the raffle ticket qualifies for a prize. If the raffle ticket qualifies for a prize, the lottery authority determines 510 if the add-on game was purchased with the base game associated to the winning raffle ticket. If the add-on game was purchased with the base game associated to the winning raffle ticket, the player receives prize associated to the winning raffle ticket 516.

If the add-on game was not purchased with the base game associated to the winning raffle ticket, player receives 512 a free QP lottery ticket with a set of player indicia for a subsequent drawing in lieu of the raffle prize. At least a percentage of the unpaid raffle prize is carried forward 514 to a subsequent drawing.

FIG. 6 is a chart depicting the allocation of the prize pool of the add-on game of the present invention. In one embodiment, the prize pool 600 is a pari-mutuel prize pool and consists of 50 percent (50%) of the gross revenue from the sale of the add-on game of the present invention over a drawing period. In one embodiment, a percentage of the gross revenue from the sale of the add-on game of the present invention over a drawing period is allocated to at least one prize reserve account before being allocated to the prize pool 600. The prize pool shall be allocated as the winning pool for the payment of prizes as provided below.

In one embodiment, the grand prize pool 602 shall consist of 50 percent (50%) of the prize pool 600 over a drawing period plus any unpaid grand prize money carried forward from previous draws. In one embodiment, if the grand prize winner in a drawing did not purchase the add-on game of the present invention at the time the base game play was purchased, the winner will receive a free QP lottery ticket in lieu of the associated grand prize, which is funded by a reserve pool. The grand prize amount allocated to that winning raffle ticket will not be awarded and shall be carried over and added to the grand prize pool 602 of a subsequent drawing. In one embodiment, money in the grand prize pool 602 is multiplied by an annuity factor or similar multiple to determine a published grand prize amount, whereby the grand prize amount is paid out to a winner, through an annuity or similar financial instrument, in a series of payments over a multiple of years. In one embodiment, grand prizes awarded are paid as single, lump sum prizes. In one embodiment, the grand prize pool 602 is known as the jackpot pool and the grand prize is known as the jackpot.

The fixed prize pool 604 shall consist of 50 percent (50%) of the prize pool 600 over a drawing period plus any unpaid fixed prize money carried forward from previous draws. In one embodiment, the fixed prize pool 604 is allocated to a number of fixed $1 million, $100,000, $10,000, and $500 prize units, defined by the following formula:

(a) Seventy-five percent (75%) of the fixed prize pool, rounded down to the nearest million dollar denomination, shall be allocated to the maximum number of million dollar prize units 606;

(b) Seventy-five percent (75%) of the remaining fixed prize pool, rounded down to the nearest hundred thousand dollar denomination, shall be allocated to the maximum number of hundred thousand dollar prize units 608;

(c) Seventy-five percent (75%) of the remaining fixed prize pool, rounded down to the nearest ten thousand dollar denomination, shall be allocated to the maximum number of ten thousand dollar prize units 610;

(d) One hundred percent (100%) of the remaining fixed prize pool, rounded down to the nearest five hundred dollar denomination, shall be allocated to the maximum number of five hundred dollar prize units 612;

(e) One hundred percent (100%) of the remaining fixed prize pool shall be placed in trust in one or more prize reserve accounts for QP lottery ticket prizes 614. In one embodiment, once the prize reserve accounts exceed a pre-designated amount, the excess shall become part of the following fixed prize pool 604.

In one embodiment, the allocation of the fixed prize pool 604 may be modified to positively impact sales as determined by the sponsoring state lottery. The modification of the fixed prize pool allocation may include different allocation percentages and a number of different fixed prize amounts, including but not limited to Ten Million Dollar prize units ($10,000,000), Five Million Dollar prize units ($5,000,000), Two Million Dollar prize units ($2,000,000), One Million Dollar prize units ($1,000,000), Five Hundred Thousand Dollar prize units ($500,000), Two Hundred Fifty Thousand Dollar prize units ($250,000), One Hundred Thousand Dollar prize units ($100,000), Fifty Thousand Dollar prize units ($50,000), Twenty Five Thousand Dollar prize units ($25,000), Ten Thousand Dollar prize units ($10,000), Five Thousand Dollar prize units ($5,000), One Thousand Dollar prize units ($1,000), Five Hundred Dollar prize units ($500), Two Hundred Fifty Dollar prize units ($250), One Hundred Dollar prize units ($100), and QP lottery ticket prize units.

In one embodiment, if a fixed prize winner in a drawing did not purchase the add-on game of the present invention at the time the base game play was purchased, the winner will receive a free QP lottery ticket in lieu of the associated fixed prize, which is funded by a reserve pool. The fixed prize amount allocated to that winning raffle ticket will not be awarded and shall be carried over and added to the fixed prize pool 604 of a subsequent drawing. In one embodiment, fixed prizes awarded are paid as single, lump sum prizes or annuitized prizes. In one embodiment, the prize pool 600 is allocated to only the grand prize pool 602 or the fixed prize pool 604.

FIG. 7. is a model developed using the premise of the add-on game of the present invention as applied to a plurality of existing state lottery jackpot games. The model depicts a hypothetical weekly add-on raffle game drawing using actual ticket sales data and the number of winners matching at least 3 numbers in the Florida lottery jackpot games (base games) Lotto™, Mega Money®, and Fantasy 5™, between the dates Jan. 1-Jul. 1, 2006, as published by the Florida lottery. The model comprises a multiple of sections; ticket sales 700, fixed (set) prizes 710, grand prize 720, and odds, 730, further described as follows.

The Ticket Sales section 700 depicts total base game ticket sales 702 over each weekly draw period 701, a hypothetical sell through percentage 704 of the add-on game of the present invention, and the resulting amount of ticket sales 706 and weekly prize pool 708 for the add-on game of the present invention for each weekly draw period 701.

The Fixed (Set) Prizes section 710 depicts the amount of money in the fixed prize pool 712, which is comprised of 50% of the prize pool 708 over each weekly sales period plus any unpaid fixed prize amounts carried forward from previous draws, as previously described. Using the formula previously described, the fixed prize pool 712 is allocated to a number of $1 million prize units 714, $100,000 prize units 715, $10,000 prize units 716, $500 prize units 717, with the remaining balance allocated towards the QP ticket reserve 718. This section also depicts the percentage of prizes hypothetically paid out 719 over each weekly draw period, which correlates to the hypothetical sell through percentage 704 of the add-on game of the present invention. If only 10% of all base game players purchased the add-on game of the present invention, then statistically, no more than 10% of the recipients of winning raffle tickets purchased the add-on game of the present invention, and will receive a prize payout. In this example, 10% of the fixed prize amounts 714-717 are paid out, and the remaining 90% of fixed prize amounts 714-717 rollover to the subsequent drawing.

The Grand Prize section 720 depicts the amount of money in the grand prize pool 722, which is comprised of 50% of the prize pool 708 over each weekly sales period plus any unpaid fixed prize amounts carried forward from previous draws, as previously described. The grand prize pool 722 is multiplied by an annuity factor, as previously described, to determine the published annuitized grand prize 724. This section also contains a hypothetical column of grand prize winners 726, which depicts the hypothetical payout of the grand prize 724, and a column depicting the probability of a grand prize payout 728. Since the grand prize 724 is a single prize, each drawing will result in a complete payout or no payout at all. If only 10% of all base game players purchased the add-on game of the present invention, then statistically, there would be no more than a 10% probability that the recipient of the winning grand prize raffle ticket purchased the add-on game of the present invention, and will receive the grand prize payout. In the drawings in which the hypothetical grand prize is not paid out, the grand prize amount rolls over to the subsequent drawing. As the amount of fixed prizes 710 and grand prize amount 720 increases, a higher sell through percentage 704 is projected. As a higher percentage of players purchase the add-on game of the present invention, there is a higher likelihood that the fixed prizes 710 and grand prize 720 will be paid out in a particular draw.

The Odds section 730 reflects the amount of base game qualifiers 732, or "winners" in each draw period who have successfully matched at least 3 numbers in the Florida lottery jackpot games (base games) Lotto™, Mega Money®, and Fantasy 5™, between the dates Jan. 1-Jul. 1, 2006, as published by the Florida lottery, as well as the number of raffle prizes offered 734 in each weekly draw period, and the odds of winning a raffle prize 736 in each raffle draw period. The actual odds of winning a raffle prize for a raffle ticket recipient is determined by both the amount of winning base game tickets that are redeemed during the draw period, and the number of prizes offered during the draw period. The odds of a player matching at least 3 numbers in a base game to qualify to receive a raffle ticket are determined by the base game.

In one embodiment, the fixed prize pool 712 and grand prize pool 722 are mutually exclusive. As depicted in the line defined as week 13 740, tickets sales for the add-on game of the present invention are lower than the previous week, as the grand prize was hypothetically paid out the week before. In this hypothetical draw period, although the gross add-on game ticket sales were only $2,814,096 with a weekly prize pool of only $1,407,048, the lottery was able to offer (1) $1,496,860 annuitized grand prize (3) $1 million fixed prizes, (12) $100,000 fixed prizes, (39) $10,000 prizes, and (279) $500 prizes, or a total of $6,226,360 in prizes in this drawing period. One benefit of mutually exclusive prize pools is to provide a consistent offering of prizes to players, a.k.a. "prize momentum". In one embodiment, if a payout from either the grand prize pool 722 or the fixed prize pool 712 is equal to or greater than a pre-defined threshold in any particular drawing, leaving the prize pool deficient, a higher percentage of the prize pool 708 of subsequent drawings is allocated to the deficient prize pool(s) until said pool reaches a second pre-defined threshold. As an example, in the hypothetical week 13 740, $703,524 is allocated to the grand prize pool 722, and $703,524 is allocated to the fixed prize pool 712. Seeing that the grand prize pool 722 was completely paid out in the previous drawing, the present embodiment would allow for 100% of the prize pool 708 accumulated in week 13 740, or $1,407,048 to be allocated to the grand prize pool 722, and such allocation percentage would continue until the grand prize pool 722 reached or exceeded a pre-defined threshold, such as an amount needed to fund a guaranteed minimum grand prize. The benefit of said embodiment would be the opportunity to quickly accumulate a grand prize pool amount large enough to retain player interest and avoid fatigue.

Figure 8A:
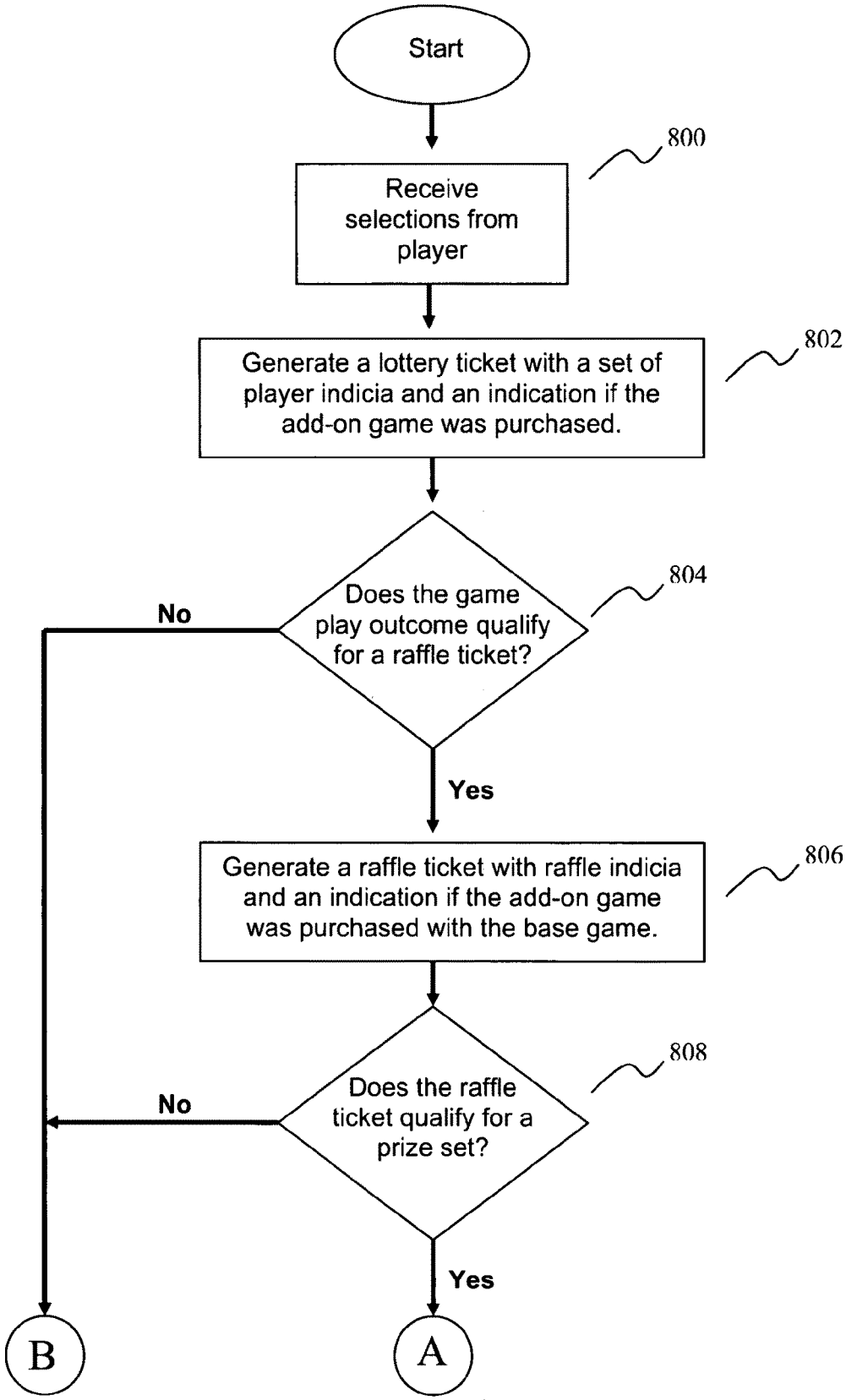
FIGS. 8A&B depict a lottery game server process according to one embodiment of the present invention.
Figure 8B:
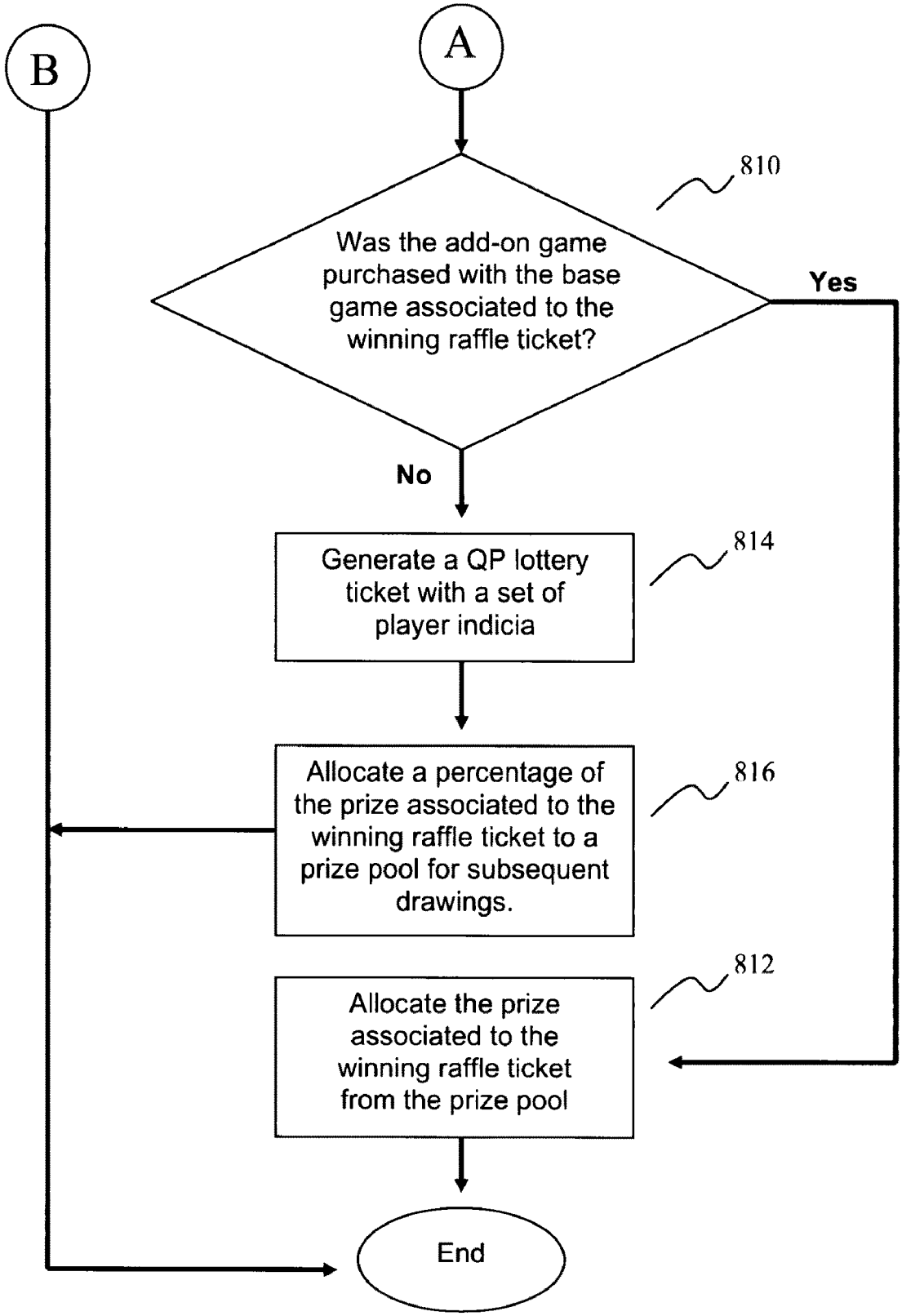

FIG. 8 depicts a lottery game server process according to one embodiment of the present invention. The game server hosts a base on-line game or a raffle game, and includes a means for receiving a plurality of game entries, each game entry having at least one set of player indicia, a means for storing a prize table and a plurality of game entries; and a controlling means.

The lottery authority receives 800 a set of player indicia from at least one player with a wager to play a lottery game, and an indication whether or not the player is purchasing the add-on game of the present invention. The lottery authority generates 802 a lottery ticket with a set of player indicia and an indication if the add-on game was purchased. After the drawing, the lottery ticket is submitted to the lottery authority, who determines 804 if the game play outcome qualifies for a raffle ticket. If the game play outcome does qualify for a raffle ticket, the lottery authority generates 806 a raffle ticket with raffle indicia and an indication if the add-on game was purchased with the base game. After the raffle drawing, the raffle ticket is submitted to the lottery authority, who determines 808 if the raffle ticket qualifies for a prize. If the raffle ticket qualifies for a prize, the lottery authority determines 810 if the add-on game was purchased with the base game associated to the winning raffle ticket. If the add-on game was purchased with the base game associated to the winning raffle ticket, the lottery authority allocates 812 the prize associated to the winning raffle ticket from the prize pool to the raffle ticket recipient. If the add-on game was not purchased with the base game associated to the winning raffle ticket, the lottery authority generates 814 a QP lottery ticket with a set of player indicia for a subsequent drawing to be given to the raffle ticket recipient in lieu of the raffle prize, and allocates 816 a percentage of the prize associated to the winning raffle ticket to a prize pool for subsequent drawings.

The controlling means is capable of (a) receiving a set of player indicia from at least one player 800, (b) generating a lottery ticket with a set of player indicia and an indication if the add-on game was purchased 802, (c) determining if the game play outcome qualifies for a raffle ticket 804, (d) generating a raffle ticket with raffle indicia and an indication if the add-on game was purchased with the base game 806, (e) determining if the raffle ticket qualifies for a prize set 808, (f) determining if the add-on game was purchased with the base game associated to the winning raffle ticket 810, (g) allocating the prize associated to the winning raffle ticket from the prize pool if the add-on game was purchased with the base game associated to the winning raffle ticket 812, and (h) generating a QP lottery ticket with a set of player indicia for a subsequent drawing 814 and/or allocating a percentage of the prize associated to the winning raffle ticket to a prize pool for subsequent drawings 816 if the add-on game was not purchased with the base game associated to the winning raffle ticket. In one embodiment, the controlling means is a computer readable medium on which is stored a computer program for playing on-line games and the raffle game of the present invention, the computer program comprising computer instructions that when executed by a computer perform the steps outlined herein.

Lightning Strikes Twice™ Suggested Game Rules

The Following are suggested game rules for the add-on raffle game embodiment of the present invention. The rules are presented as one embodiment of the present invention, and should not be viewed as fixed or limiting.

I. Purpose

These rules establish the procedures and requirements for playing the Lightning Strikes Twice™ game, a lottery add-on game operated by the _____ State/Federal Lottery.

II. Definitions

The following definitions apply unless the context requires a different meaning.

(1) "Base Game Play" means a single game play of a Lottery jackpot game that permits the Lightning Strikes Twice™ add-on game.

(2) "Drawing" means the formal process of selecting winning numbers which determine the winners for each prize level of the game.

(3) "Fixed Prize" means all prizes of a guaranteed amount withstanding the Grand Prize that are advertised to be paid by a single lump sum payment and, except in instances outlined in these rules, will be equal to the prize amount established by the Lottery for the prize level.

(4) "Fixed Prize Pool" means the portion of the Prize Pool set aside for the payment of the Fixed Prizes. The Fixed Prize Pool for any drawing is expected to be 50% of the Prize Pool plus any fixed prize money carried forward from previous draws, but may be higher or lower based upon the funding required to meet the advertised Fixed Prizes.

(5) "Game Ticket" or "Ticket" means a valid ticket produced by a terminal which contains one or more lettered game plays along with the drawing date, the price of the ticket, a retailer number and a serial number that is compatible with the Lottery's online operating system transaction log.

(6) "Grand Prize" means the top prize in the Lightning Strikes Twice™ game which is determined on a pari-mutuel basis and may be paid by a single lump sum payment or by annual installments.

(7) "Grand Prize Pool" means the portion of the Prize Pool set aside for the payment of the Grand Prize. The Grand Prize Pool for any drawing is expected to be 50% of the Prize Pool plus any unpaid grand prize money carried forward from previous draws, but may be higher or lower based upon the funding required to meet the advertised Grand Prize.

(8) "Jackpot Game" means a state lottery game in which a pari-mutuel jackpot can be won.

(9) "Lightning Strikes Twice™ annuity prize" means the amount in the Grand Prize pool is multiplied by the market rate annuity factor to calculate the total Grand Prize payout amount to be paid annually in thirty equal payments. The annuity factor is the rate determined at market bid, given the amount to be invested on behalf of the prize winner over the full term of the life of the annuity.

(10) "Lightning Strikes Twice™ Raffle Ticket" or "Raffle Ticket" means a raffle ticket produced by a terminal which contains a single unique ticket number, the drawing date, an indicator if the Lightning Strikes Twice™ add-on game was purchased with the winning base game play, a retailer number and a serial number that is compatible with the bet file and validation record on the Lottery's online operating system.

(11) "Lottery" means the State or Federal Lottery.

(12) "Official Winning Numbers" or "Winning Numbers" means the numbers randomly selected by the Lottery as the winning numbers in a single drawing, certified and entered into the online lottery system, which shall be used to determine winning plays contained on a game ticket or raffle ticket.

(13) "Prize Level" means the total amount of sales allocated to pay prize Claimants, at the designated prize level.

(14) "Play" or "Game Play" means the five or six numbers required to play in a single Lottery jackpot game drawing, which appear on a ticket as a single lettered selection and are to be played by a player in the game.

(15) "Play Slip" or "Game Slip" means the paper used in marking a player's game plays and containing one or more boards (complete "play combinations".

(16) "Owner" means the bearer of a game ticket or raffle ticket before or after a signature is placed in the area designated for signature. The "player is the one purchasing or holding the ticket at the time of the drawing".

(17) "Prize Pool" means the portion of the Lightning Strikes Twice™ gross sales set aside for the payment of prizes. The prize pool for any drawing is expected to be 50% of sales, but may be higher or lower based upon the number of winners at fixed prize levels, as well as the funding required to meet the advertised Grand Prize.

(18) "QP Lottery Ticket" means a quick pick lottery ticket with the numbers selected randomly by the lottery system not the player.

(19) "Qualifying Base Game Play" means matching at least 3 of the official winning numbers in a single game play line of a Lottery jackpot game, which qualifies a player for a single Lightning Strikes Twice™ raffle ticket.

(20) "Raffle Drawing" means a random computerized drawing from among all raffle ticket numbers issued during the sales period.

(21) "Retailer" means a person or entity authorized by the Lottery to sell lottery tickets.

III. Ticket Price (1) A Lightning Strikes Twice™ add-on game shall cost one dollar (USA $1) per play or another amount determined by the Lottery.

(2) An offer to buy and an offer to sell a Lightning Strikes Twice™ add-on game shall be made only at a location which has a retailer contract with the Lottery or only by a method which is approved by the Lottery.

(3) The Lottery shall not directly and knowingly sell a Lightning Strikes Twice™ add-on game to any person or entity where said purchaser is guaranteed to win a Grand Prize.

IV. Game Description (1) Lightning Strikes Twice™ is a progressive raffle add-on game which can be added at the time of purchase to one of the following State Lottery games that offers a Jackpot Prize. The Lightning Strikes Twice™ add-on game offers players who match at least 3 of the official winning numbers in a base jackpot game the opportunity to participate in a progressive raffle draw which offers a number of fixed cash prizes and a pari-mutuel Grand Prize.

(2) Upon redeeming a winning lottery game play which matches at least 3 of the official winning numbers in a base jackpot game, a player will receive a Lightning Strikes Twice™ raffle ticket containing a unique ticket number that will automatically be entered into the following Lightning Strikes Twice™ raffle drawing at no additional cost to the player. Each Lightning Strikes Twice™ raffle ticket contains only one ticket number and will automatically print from the terminal with ticket numbers issued in sequential order as associated winning game plays are redeemed around the state. Players cannot select their own ticket numbers. Each Lightning Strikes Twice™ raffle ticket indicates whether or not the Player purchased the Lightning Strikes Twice™ add-on game during the initial purchase of their associated winning game play. Players who redeem associated winning game plays past the weekly specified cut-off period will receive a Lightning Strikes Twice™ raffle ticket for the next following draw.

(3) It is the sole responsibility of the player to verify the accuracy of the original game play or plays, the indicator for whether or not they purchased the Lightning Strikes Twice™ add-on game to the original game play or plays, and other data printed on the ticket. A Raffle Ticket may not be voided or canceled by returning the ticket to the retailer or to the Lottery, including tickets that are printed in error. No ticket shall be returned to the Lottery for credit. The placing of plays is done at the player's own risk through the online retailer.

(4) The Lightning Strikes Twice™ Raffle Drawing is held periodically, and offers a number of fixed cash prizes and a pari-mutuel grand prize to players with matching numbers. Each Lightning Strikes Twice™ Raffle drawing shall be conducted with appropriate security and audit oversight and policies. A total of one Grand Prize and a multiple of Fixed Prizes, based on the amount available in the Fixed Prize Pool as allocated according to the rules in Section VII. (7) will be awarded. Prizes will be awarded in the order drawn. The first number drawn will win the Grand Prize. The following numbers drawn equal to the published amount of $1 million prizes offered in the drawing will win $1 million. The following numbers drawn equal to the published amount of $100,000 prizes offered in the drawing will win $100,000. The following numbers drawn equal to the published amount of $10,000 prizes offered in the drawing will win $10,000. The following numbers drawn equal to the published amount of $500 prizes offered in the drawing will win $500.

(5) To be eligible to receive the cash prize associated to an official winning Raffle ticket, a player must have purchased the Lightning Strikes Twice™ add-on game at the time the base game play was purchased. If the Owner of an official winning Raffle Ticket did not purchase the Lightning Strikes Twice™ add-on game at the time the base game play was purchased, the owner will receive a free QP lottery ticket in lieu of the associated cash prize. The cash prize associated to the winning Raffle ticket will not be awarded and will rollover to the subsequent Lightning Strikes Twice™ Raffle Drawing.

(6) The results of each drawing will be revealed on the Lottery's Web site, by phone or at a lottery retailer.

V. Prize Claims (1) Winning Lightning Strikes Twice™ Raffle tickets must be presented to a Lottery office for payment. The number on a raffle ticket must match the winning number drawn in EXACT ORDER. Tickets winning a free QP lottery ticket can be redeemed at any authorized Lottery retailer. Tickets winning $1 million or more must be submitted for payment at the Lottery Headquarters. Information about procedures for filing a claim can be obtained by calling Lottery Headquarters. Lightning Strikes Twice™ Raffle tickets are the only valid receipts to redeem a prize.

(2) Lightning Strikes Twice™ Raffle tickets must be validated within a number of days from the date of the drawing. If the prize is not paid at the time of validation, the player must submit the winning ticket for payment at any Lottery prize claim office, as required by the Lottery's rules governing the payment of prizes.

(3) If a winning Lightning Strikes Twice™ Raffle ticket bearing any of the winning numbers associated to a fixed prize or grand prize is not submitted for validation and payment in accordance with the Lottery's rule governing payment of prizes, the associated prize will not be awarded and will rollover to the subsequent Lightning Strikes Twice™ Raffle Drawing.

(4) Lightning Strikes Twice™ Raffle tickets shall be disqualified if any part of the ticket is illegible, altered, mutilated, tampered with or duplicated. A play slip or a copy of a Lightning Strikes Twice™ Raffle ticket has no pecuniary or prize value and does not constitute evidence of any ticket purchase.

(5) Players and prize claimants must be at least a few years of age. Persons prohibited by State Statutes from purchasing a Lottery ticket are not eligible to play.

(6) All Lightning Strikes Twice™ Raffle prizes are subject to the provisions of State Statutes, and rules promulgated thereunder, including the official Lightning Strikes Twice™ Raffle rule. Prizes will be paid in accordance with the rules of the Lottery governing payment of prizes. Copies of the current prize payment rule and the Lightning Strikes Twice™ Raffle rule can be obtained from the Lottery.

(7) Payment of all federal, state and/or local taxes will be the responsibility of the winner. Federal withholding taxes will be deducted from the cash payment for prize amounts for which withholding is required by IRS Regulations.

(8) By purchasing a ticket and claiming a prize, winners grant the Lottery the right to use winners' Name, City, County and State of residence, prize amount and photograph or likeness to advertise and promote games or goodwill for the Lottery.

VI. Prize Pool (1) The prize pool is allocated to a number of fixed prizes and a pari-mutuel grand prize, and shall consist of 50 percent (50%) of each Lightning Strikes Twice™ drawing period's sales, including tax, that remain after funding the Prize Reserve Accounts to the amounts established by the Lottery. Any amount remaining in the Prize Pool at the end of this game shall be carried forward to a replacement game or expended in a manner as directed by the Lottery in accordance with state law.

(2) Two percent of sales, including tax, shall be placed in trust in one or more Prize Reserve Accounts until the Prize Reserve Accounts reach the amounts designated by the Lottery. Once the Prize Reserve Accounts exceed the designated amounts, the excess shall become part of the Prize Pool. Any amount remaining in a Prize Reserve Account at the end of this game shall be carried forward to a replacement Prize Reserve Account or expended in a manner as directed by the Lottery in accordance with state law.

(3) The Prize Pool shall be allocated as provided below.

(4) The Grand Prize Pool shall consist of 50 percent (50%) of the Prize Pool for the drawing plus any unpaid grand prize money carried forward from the previous draws. If the grand prize winner in a drawing did not purchase the Lightning Strikes Twice™ add-on game at the time the base game play was purchased, the winner will receive a free QP lottery ticket in lieu of the associated grand prize. The grand prize amount allocated to that winning raffle ticket will not be awarded and shall be carried over and added to the Grand Prize Pool of the subsequent Lightning Strikes Twice™ drawing.

(5) The Lottery may offer guaranteed minimum Grand Prize amounts or minimum increases in the Grand Prize amount between drawings or make other changes in the allocation of prize money where the Lottery finds that it would be in the best interest of the game. If a minimum Grand Prize amount or a minimum increase in the Grand Prize amount between drawings is offered by the Lottery, then the Prize Pool percentage allocated to the Grand Prize in subsequent drawings shall be increased to 100 percent (100%) until the amount accumulated in the Grand Prize pool, as determined by the Lottery, is sufficient to fund the minimum Grand Prize amount or a minimum increase in the Grand Prize amount between drawings, with the remainder in a given drawing period funding the Fixed Prize Pool.

(6) If the total of the Grand Prize awarded in a drawing exceeds the amount in the Grand Prize pool allocated to the Grand Prize, then the amount needed to fund the Grand Prize awarded shall be drawn from the following sources, in the following order:

(A) The amount allocated to unpaid fixed prizes that is carrying forward to a subsequent draw, if any;

(B) An amount from the Prize Reserve Account, if available, not to exceed $_____ ,000,000 per drawing;

(C) The amount allocated to fixed prize payouts for the drawing;

(D) If, after these sources are depleted, there are not sufficient funds to pay the fixed prizes awarded, then all fixed prizes shall become pari-mutuel prizes, and the amount remaining in the Fixed Prize Pool shall be divided among the winning plays in proportion to their respective prize percentages.

(7) The Fixed Prize Pool shall consist of 50 percent (50%) of the prize pool for the drawing plus any fixed prize money carried forward from the previous draws. The Fixed Prize Pool will be allocated to a number of subcategory fixed $1 million, $100,000, $10,000, and $500 prizes, defined by the following formula:

(a) Seventy-five percent (75%) of the Fixed Prize pool, rounded down to the nearest million dollar denomination, shall be allocated to the maximum number of million dollar prize units;

(b) Seventy-five percent (75%) of the remaining Fixed Prize pool, rounded down to the nearest hundred thousand dollar denomination, shall be allocated to the maximum number of hundred thousand dollar prize units;

(c) Seventy-five percent (75%) of the remaining Fixed Prize pool, rounded down to the nearest ten thousand dollar denomination, shall be allocated to the maximum number of ten thousand dollar prize units;

(d) One hundred percent (100%) of the remaining Fixed Prize pool, rounded down to the nearest five hundred dollar denomination, shall be allocated to the maximum number of five hundred dollar prize units;

(e) One hundred percent (100%) of the remaining Fixed Prize pool shall be placed in trust in one or more prize reserve accounts for QP lottery ticket prizes, until the prize reserve accounts reach the amounts designated by the Lottery. Once the prize reserve accounts exceed the designated amounts, the excess shall become part of the subsequent Fixed Prize pool.

(8) The allocation of the Fixed Prize pool may be modified by the Lottery from time to time to include a number of subcategories, including Ten Million Dollar prize units ($10,000,000), Five Million Dollar prize units ($5,000,000), Two Million Dollar prize units ($2,000,000), One Million Dollar prize units ($1,000,000), Five Hundred Thousand Dollar prize units ($500,000), Two Hundred Fifty Thousand Dollar prize units ($250,000), One Hundred Thousand Dollar prize units ($100,000), Fifty Thousand Dollar prize units ($50,000), Twenty Five Thousand Dollar prize units ($25,000), Ten Thousand Dollar prize units ($10,000), Five Thousand Dollar prize units ($5,000), One Thousand Dollar prize units ($1,000), Five Hundred Dollar prize units ($500), Two Hundred Fifty Dollar prize units ($250), One Hundred Dollar prize units ($100), and QP lottery ticket prize units.

(9) Modification of the Fixed Prize pool allocation shall only occur when the Lottery has determined in writing prior to the drawing that circumstances warrant the modification of such allocation amounts to positively impact sales. No more than 75% of the Fixed Prize pool may be allocated to any one subcategory in a given drawing. Under no circumstances can a fixed prize allocation in any drawing be modified after being published by the Lottery. Nothing in this rule shall be construed to prohibit a guaranteed Fixed Prize.

(10) If a Fixed Prize winner in a drawing did not purchase the Lightning Strikes Twice™ add-on game at the time the base game play was purchased, the winner will receive a free QP lottery ticket in lieu of the associated Fixed Prize. The Fixed Prize amount allocated to that winning Raffle Ticket will not be awarded and shall be carried over and added to the Fixed Prize pool of the subsequent Lightning Strikes Twice™ drawing.

(11) Except for the Grand Prize payout, as provided in these rules, all other prizes awarded shall be paid as fixed lump sum prizes.

VII. Probability of Winning (1) The following table sets forth the overall probability of winning a Lightning Strikes Twice™ Grand Prize, based on the overall odds of matching at least 3 official winning numbers in a base jackpot game and an estimated number of Lightning Strikes Twice™ players in a given raffle period. The odds of winning a raffle prize are determined by the number of raffle tickets issued and number of prizes offered in a given drawing.

(2) Matching at least 3 official winning numbers in a Jackpot Game:

| Base Jackpot Game | Overall Odds |
|---|---|
| Lotto ™ | 1:67.36 |

(3) Winning the Lightning Strikes Twice™ grand prize in a weekly raffle period: 1:330,000 (estimated)

VIII. Lightning Strikes Twice™ Estimated Prizes (1) For each drawing the Lottery will announce the estimated amount of the Lightning Strikes Twice™ Grand Prize (estimated annuity value) that can be won by a single player, based upon the estimated cash value of the Grand Prize Pool determined by projected and historical sales figures, current interest rates, and funds from rollovers, if any. In the event the cash available in the Grand Prize pool is insufficient to yield the announced estimated Grand Prize value over the annuitized payment period, the Lottery may add prize money from prize reserve accounts or from prize money rendered unclaimable by State Statutes, to the Grand Prize pool to render it sufficient to yield the announced estimated Grand Prize. Use of prize reserve accounts or unclaimable prize money to increase the Grand Prize pool for the Lightning Strikes Twice™ add-on game shall only occur when the Lottery has determined in writing prior to the drawing that circumstances warrant the use of such funds to positively impact sales. Nothing in this rule shall be construed to prohibit a guaranteed Grand Prize.

(2) For each drawing the Lottery will announce the estimated amount of various Fixed Prizes that can be won by a single player, based upon the estimated cash value of the Fixed Prize Pool determined by projected and historical sales figures, current interest rates, and funds from rollovers, if any. In the event the cash available in the Fixed Prize Pool is insufficient to yield the announced estimated Fixed Prize values in single payments, the Lottery may add prize money from prize reserve accounts or from prize money rendered unclaimable by State Statutes or by Lightning Strikes Twice™ game rules, to the Fixed Prize Pool to render it sufficient to yield the announced estimated Fixed Prizes. Use of prize reserve accounts or unclaimable prize money to increase the Fixed Prize pool for the Lightning Strikes Twice™ add-on game shall only occur when the Lottery has determined in writing prior to the drawing that circumstances warrant the use of such funds to positively impact sales. Nothing in this rule shall be construed to prohibit a guaranteed Fixed Prize.

IX. Grand Prize Payment Options (1) Grand prizes shall be paid not later than a number of days after validation of the prize, with either an annuity or single lump sum payment. If the payment election is not made by the player within a number of days after validation, then the prize shall be paid as an annuity prize. The election to take the single lump sum payment may be made at the time of validation of the prize claim or within a number of days thereafter. An election made after validation is final and cannot be revoked, withdrawn or otherwise changed. Winner(s) who elect a lump sum payment shall be paid in a single lump sum payment. The annuitized option prize shall be determined by multiplying the Grand Prize pool by the Lightning Strikes Twice™ annuity factor. (Application of the Lightning Strikes Twice™ annuity factor generally is anticipated to result in the Grand Prize winner who elects a single lump sum payment receiving an amount that roughly approximates one-half of the advertised jackpot amount. The actual single lump sum payment amount will vary as a function of the Lightning Strikes Twice™ annuity factor determined as described in subsection (4) of this rule.) The Lightning Strikes Twice™ annuity factor is determined by the best total securities price obtained through a competitive bid of qualified, pre-approved brokers made after it is determined that the prize is to be paid as an annuity prize or after the expiration of a number of days after the winner becomes entitled to the prize. The Lottery shall not be responsible or liable for changes in the advertised or estimated annuity prize amount and the actual amount purchased after the prize payment method is actually known to the Lottery. In certain instances announced by the Lottery, the Grand Prize shall be a guaranteed amount and shall be determined pursuant to subsection (4) of this rule. If the cash held to fund an annuity is less than $250,000, the Lottery, in its sole discretion, may elect to pay the winners the amount held in the Grand Prize pool. All annuitized prizes shall be paid annually in thirty equal payments with the initial payment being made directly with available funds, to be followed by twenty-nine payments funded by the annuity. Annual payments after the initial payment shall be made by the lottery on the anniversary date of the first payment or if such date falls on a non-business day, then the first business day following the anniversary date of the Lightning Strikes Twice™ drawing.

(2) Annuitized payments of the Grand Prize may be rounded to facilitate the purchase of an appropriate funding mechanism. Breakage on an annuitized Grand Prize win shall be added to the first payment to the winner or winners.

(3) If the Grand Prize is not won in a drawing, the prize money allocated for the Grand Prize shall roll over and be added to the Grand Prize pool for the following drawing. If any Fixed Prizes are not won in a drawing, the prize money allocated for the Fixed Prizes shall roll over and be added to the Fixed Prize pool for the following drawing.

(4) If the Grand Prize winner during a single drawing has elected the annuitized option prize, then the best bid submitted by the Lottery's pre-approved qualified brokers shall determine the cash pool needed to fund the guaranteed annuitized Grand Prize. If the winner of the Grand Prize during a single drawing has not elected the annuitized option prize, then the amount of the cash in the Grand Prize pool shall be an amount equal to the guaranteed annuitized amount divided by the average annuity factor of the most recent three best quotes provided by the Lottery's pre-approved qualified brokers submitting quotes. In no case shall quotes be used which are more than two weeks old, and if less than three quotes are submitted, then the Lottery shall use the average of all quotes submitted. Changes in the allocation of prize money shall be designed to retain approximately the same prize allocation percentages, over a year's time, set out in these rules.

(5) The holder of a winning ticket may win only one prize per ticket in connection with the winning raffle numbers drawn, and shall be entitled only to the prize won by those numbers in the highest matching prize category.

(6) Any interest or earnings accrued on a Lightning Strikes Twice™ Grand prize or Fixed Prize prior to the prize payment, under either the Cash Option or the Annual Payment option, shall accrue to the State and not to the winner.

Figure 9:
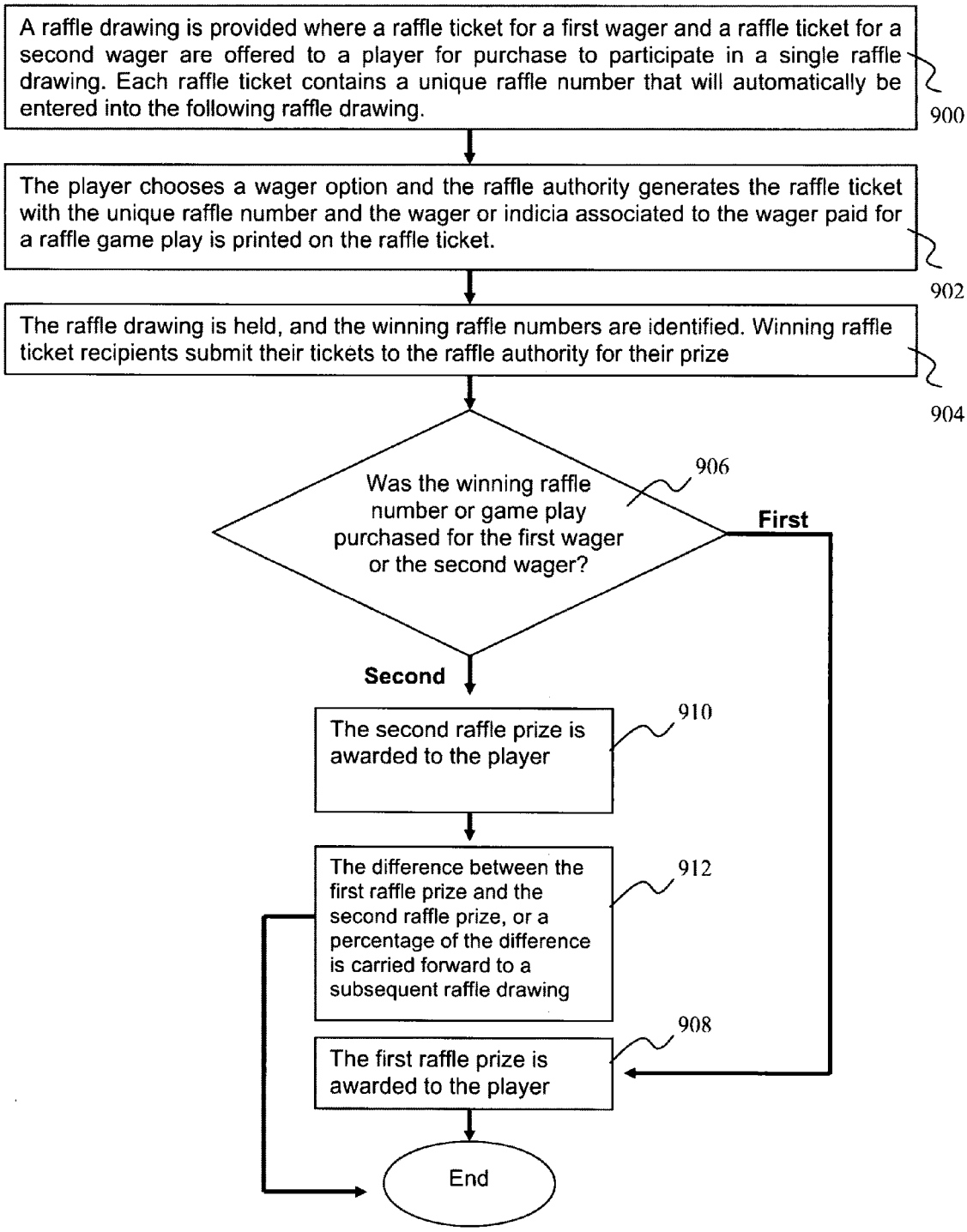
FIG. 9 depicts the premise of independent rolling raffle base game, according to one embodiment of the present invention.

FIG. 9. In one embodiment of the present invention, the add-on raffle game is an independent base game raffle drawing characterized in that a plurality of wagers can be paid to participate in a single raffle, and unpaid prizes that can be carried forward to subsequent raffle drawings. In this embodiment a raffle drawing is provided where raffle tickets for a first wager and raffle tickets for a second wager are offered to a plurality of players for purchase to participate in a single raffle drawing. Each raffle ticket contains a unique raffle number that will automatically be entered into the following raffle drawing 900.

The player chooses a wager option and the raffle authority generates the raffle ticket with the unique raffle number and the wager or indicia associated to the wager paid for a raffle game play is printed on the raffle ticket 902. In one embodiment, multiple raffle number game plays are printed on a single raffle ticket. In one embodiment, the wager or indicia associated to the wager for each raffle game play is printed on the raffle ticket A first raffle prize and/or a second raffle prize is offered to be awarded to a single winning raffle number where the first prize is larger than the second prize. In one embodiment, the total amount of first prizes offered in a single raffle drawing is equivalent to approximately 50% of the estimated ticket sales over the drawing period in addition to any unpaid prize money carried forward from previous raffle drawings. The raffle drawing is held and the winning raffle numbers are identified. Prizes are awarded in the order drawn. Winning raffle ticket recipients submit their tickets to the raffle authority for their prize 904.

A determination is made whether the winning raffle game play was purchased for the first wager or the second wager 906. If the winning raffle game play was purchased for the first wager, the first raffle prize is awarded to the player 908. If the winning raffle game play was purchased for the second wager, the second raffle prize is awarded to the player 910, where the second prize is smaller than the first prize. If the second raffle prize is awarded, the difference between the first raffle prize and the second raffle prize, or a percentage of the difference, is carried forward to a subsequent raffle drawing 912.

Also provided is a lottery game server for hosting a raffle game according to one embodiment of the present invention. The game server includes a means for receiving a plurality of raffle game plays, a means for storing a prize table and a plurality of game plays; each game play associated to a first wager amount and/or a second wager amount paid, and a controlling means.

The controlling means is capable of (a) receiving an indication of a first wager amount and/or a second wager amount to be associated to raffle game plays of a single raffle drawing 902, (b) generating a raffle ticket with a unique raffle number or raffle indicia and an indication of the wager amount paid for the raffle game play 902, (c) determining if the raffle game play qualifies for a prize 904, (d) determining if a winning raffle game play was purchased with a first wager amount or a second wager amount 906, (e) allocating a first prize associated to the winning raffle game play from a prize pool if the if the winning raffle game play was purchased with the first wager amount 908, (f) allocating a second prize associated to the winning raffle game play from a prize pool if the winning raffle game play was purchased with the second wager amount 910, and (g) allocating the difference between the first raffle prize and the second raffle prize, or a percentage of the difference to a prize pool for subsequent drawings 912 if the if the winning raffle game play was purchased with a second wager amount. In one embodiment, the controlling means is a computer readable medium on which is stored a computer program for playing on-line games and the raffle game of the present invention, the computer program comprising computer instructions that when executed by a computer perform the steps outlined herein.

Therefore, the foregoing is considered as illustrative only of the principles of the invention. Further, since numerous modifications and changes will readily occur to those skilled in the art, it is not desired to limit the invention to the exact steps shown and described, and accordingly, all suitable modifications, steps, combinations of steps, features and equivalents that may be resorted to, in order to provide an add-on raffle game fall within the scope of the invention.

It is appreciated that not every implementation will necessarily embody all or even most of the specific embodiments, details and extensions discussed above in relation to the basic method. The games, methods and systems are described in the above manner to reduce the need for external reference when attempting to understand the context in which the alternative embodiments and aspects of the present invention operate. For that matter, it is to be appreciated that all embodiments taught are applicable to all games, methods and systems presented herein, and fall within the scope of the invention.

Should any provision of this patent be void or unenforceable for any reason, such provision shall be deemed omitted and this patent with such provision omitted shall remain in full force and effect.

What is claimed is:

1. A system for conducting a raffle add-on game, the game system comprising:

an electronic server for receiving data for a plurality of game entries purchased by players of a lottery game, each game entry having at least one set of indicia and whether or not a raffle game add-on is purchased therewith and storing electronic representations of the plurality of game entries;

a controller to generate a lottery result, wherein entries qualify for lottery awards based on a qualifying condition;

wherein rules are stored in a computer storage medium to be implemented by an electronic processor to perform the method of:

a) a particular entry qualifies for a raffle game play in a raffle game based on a comparison of the particular entry's set of indicia and the lottery result, and if the particular entry does not qualify for the raffle game then the particular entry is not entered into the raffle game, otherwise proceed to operation b;

b) after the raffle game, if the raffle game play for the particular entry loses the raffle game then the raffle game play does not win a raffle award, otherwise proceed to operation c;

c) if the raffle game play wins the raffle game and the particular entry was purchased with the raffle game add-on then the raffle game play for the particular entry wins a first prize, and if the raffle game play wins the raffle game and the particular entry was not purchase with the raffle game add-on then the raffle game play for the particular entry wins a second prize;

wherein the first prize is more valuable than the second prize, wherein the second prize is nothing or a free game play in a subsequent lottery or drawing.

2. The system of claim 1 wherein if the particular entry wins the first prize then the first prize is paid out from a raffle pool.

3. The system of claim 2 wherein, if the raffle game play for the particular entry wins the second prize then some of the first prize that the raffle game play for the particular entry would have won if the particular entry had been purchased with the raffle game add-on is used toward a subsequent raffle drawing pool.

4. The system of claim 1 further generates raffle game play indicia with the set of indicia.

5. The system of claim 1 wherein, when the particular entry qualifies for the raffle game in operation a, the raffle game play does not require a separate physical entry.

6. The system of claim 1 wherein a percentage of unpaid prize monies are carried forward to a prize pool of a subsequent drawing.

7. The system of claim 1, wherein a percentage of a prize pool is allocated to a set prize and a percentage of the prize pool is allocated to a pari-mutuel prize.

* * * * *